US011766872B2

(12) United States Patent
Matsumura et al.

(10) Patent No.: US 11,766,872 B2
(45) Date of Patent: Sep. 26, 2023

(54) PRINTING APPARATUS

(71) Applicant: CANON KABUSHIKI KAISHA, Tokyo (JP)

(72) Inventors: Hideaki Matsumura, Kanagawa (JP); Daiju Takeda, Kanagawa (JP); Tetsu Hamano, Tokyo (JP); Nobuhiro Toki, Kanagawa (JP); Fumie Kameyama, Tokyo (JP); Koki Shimada, Kanagawa (JP); Shota Asada, Tokyo (JP); Ken Takenaga, Kanagawa (JP); Yusuke Tanaka, Kanagawa (JP); Yuta Araki, Chiba (JP); Taiji Maruyama, Kanagawa (JP); Atsushi Matsuyama, Kanagawa (JP); Yusuke Naratani, Tokyo (JP); Kousuke Tanaka, Kanagawa (JP); Koya Iwakura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/357,665

(22) Filed: Jun. 24, 2021

(65) Prior Publication Data

US 2022/0009244 A1 Jan. 13, 2022

(30) Foreign Application Priority Data

Jul. 8, 2020 (JP) ..... 2020-117930

(51) Int. Cl.
*B41J 2/175* (2006.01)

(52) U.S. Cl.
CPC .. *B41J 2/17566* (2013.01); *B41J 2002/17586* (2013.01)

(58) Field of Classification Search
CPC .... B41J 2/175; B41J 2/17503; B41J 2/17506; B41J 2/17509; B41J 2/17513;
(Continued)

(56) References Cited

U.S. PATENT DOCUMENTS 5,793,395 A 8/1998 Tanaka et al. ..... 347/85
6,082,851 A 7/2000 Shihoh et al. ..... 347/85
(Continued)

FOREIGN PATENT DOCUMENTS

CN 1496842 A 5/2004
CN 102596576 7/2012
(Continued)

OTHER PUBLICATIONS

U.S. Appl. No. 17/375,541, filed Jul. 14, 2021.
(Continued)

*Primary Examiner* — Anh T Vo
(74) *Attorney, Agent, or Firm* — Venable LLP

(57) ABSTRACT

A print head includes a nozzle array comprising a plurality of nozzles, and a negative pressure generating portion configured to apply a negative pressure to the nozzle array. A tank includes a storage portion and an air communication port. A tube connects the print head and the tank and supply the liquid from the tank to the print head. A highest position of a liquid level in the tank in the vertical direction is higher than a position of the nozzle array, and an absolute value of a water head difference caused by a difference between the highest position of the liquid level in the tank and the position of the nozzle array is not larger than an absolute value of a negative pressure generated by the negative pressure generating portion.

21 Claims, 9 Drawing Sheets

(58) Field of Classification Search
CPC .... B41J 2/17566; B41J 2/17596; B41J 29/02; B41J 29/38; B41J 2002/17586
See application file for complete search history.

(56) References Cited

U.S. PATENT DOCUMENTS

| | | | | |
|---|---|---|---|---|
| 6,234,615 | B1 * | 5/2001 | Tsukuda | B41J 2/17509 347/85 |
| 7,152,954 | B2 * | 12/2006 | Katayama | B41J 2/17523 347/49 |
| 7,543,923 | B2 * | 6/2009 | McNestry | B41J 2/175 347/85 |
| 7,543,925 | B2 * | 6/2009 | Ishizawa | B41J 2/17513 347/85 |
| 9,409,407 | B2 | 8/2016 | Kudo et al. | B41J 2/17523 |
| 9,738,081 | B2 | 8/2017 | Kimura et al. | B41J 2/175 |
| 9,878,551 | B2 * | 1/2018 | Shimizu | B41J 2/17553 |
| 10,118,396 | B2 * | 11/2018 | Kimura | B41J 29/13 |
| 2004/0061748 | A1 * | 4/2004 | Kuwabara | B41J 2/17509 347/85 |
| 2007/0195144 | A1 | 8/2007 | McNestry | |
| 2011/0109706 | A1 | 5/2011 | Murray | B41J 2/19 |
| 2013/0100205 | A1 | 4/2013 | Sunouchi et al. | B41J 2/175 |
| 2017/0050443 | A1 | 2/2017 | Agarwal | B41J 2/175 |
| 2017/0120609 | A1 * | 5/2017 | Kimura | B41J 2/17523 |
| 2017/0305163 | A1 | 10/2017 | Kimura et al. | B41J 2/175 |
| 2019/0263135 | A1 | 8/2019 | Abe et al. | B41J 2/175 |
| 2020/0316973 | A1 | 10/2020 | Toki et al. | B41J 2/17523 |
| 2021/0300052 | A1 | 9/2021 | Takei et al. | B41J 2/17556 |

FOREIGN PATENT DOCUMENTS

| | | |
|---|---|---|
| CN | 103057273 | 4/2013 |
| CN | 106488846 | 3/2017 |
| CN | 106626765 A | 5/2017 |
| CN | 109927414 | 6/2019 |
| CN | 110181946 | 8/2019 |
| JP | 2001-162831 | 6/2001 |
| WO | 2014/112344 | 1/2017 |

OTHER PUBLICATIONS

U.S. Appl. No. 17/370,948, filed Jul. 8, 2021.
U.S. Appl. No. 17/370,955, filed Jul. 8, 2021.
Office Action dated Dec. 28, 2022 in counterpart Chinese Application No. 202110771975.4, together with English translation thereof.
Chinese Office Action dated May 19, 2023 in counterpart Chinese Patent Appln. No. 202110771975.4.

* cited by examiner

PRINTING APPARATUS

BACKGROUND OF THE INVENTION

Field of the Invention

The present invention relates to a printing apparatus.

Description of the Related Art

Conventionally, there are known printing apparatuses, each of which includes a print head mounted on a movable carriage, and an ink tank arranged independently of the carriage and connected to the carriage by a tube, and employs a configuration in which a user can inject ink to the ink tank. Among such printing apparatuses, there is known an apparatus in which an air introducing path is arranged at a position lower than a nozzle of the print head so that the ink tank can be stored such that the ink liquid level in the ink tank becomes higher than the nozzle of the print head, thereby implementing stable supply of ink and the high degree of freedom in arrangement of the ink tank.

In the printing apparatus disclosed in International Publication No. 2014/112344, by covering an ink injection port by a part of a lid, it is prevented that a cap of the injection port of an ink tank comes off and the stable supply of ink to the print head is impaired.

SUMMARY OF THE INVENTION

According to one embodiment of the present invention, there is provided a printing apparatus comprising: a print head including a nozzle array comprising a plurality of nozzles for discharging a liquid, and a negative pressure generating portion configured to apply a negative pressure to the nozzle array; a tank including a storage portion configured to store the liquid, and an air communication port configured to allow the storage portion to communicate with air; and a tube configured to connect the print head and the tank and supply the liquid from the tank to the print head, wherein a highest position of a liquid level in the tank in the vertical direction is higher than a position of the nozzle array, and an absolute value of a water head difference caused by a difference between the highest position of the liquid level in the tank and the position of the nozzle array is not larger than an absolute value of a negative pressure generated by the negative pressure generating portion.

According to another embodiment of the present invention, there is provided a printing apparatus comprising: a print head including a nozzle array comprising a plurality of nozzles for discharging a liquid, and a negative pressure generating portion configured to apply a negative pressure to the nozzle array; a tank including a storage portion configured to store the liquid, an air communication port configured to allow the storage portion to communicate with air, and a buffer chamber provided above the storage portion in a vertical direction and configured to be capable of storing the liquid flowing out from the storage portion; and a tube configured to connect the print head and the tank and supply the liquid from the tank to the print head, wherein a highest position of a liquid level in the buffer chamber in a vertical direction is higher than a position of the nozzle array, and an absolute value of a water head difference caused by a difference between the highest position of the liquid level in the buffer chamber and the position of the nozzle array is not larger than an absolute value of a negative pressure generated by the negative pressure generating portion.

Further features of the present invention will become apparent from the following description of exemplary embodiments (with reference to the attached drawings).

DESCRIPTION OF THE EMBODIMENTS

Figure 1:
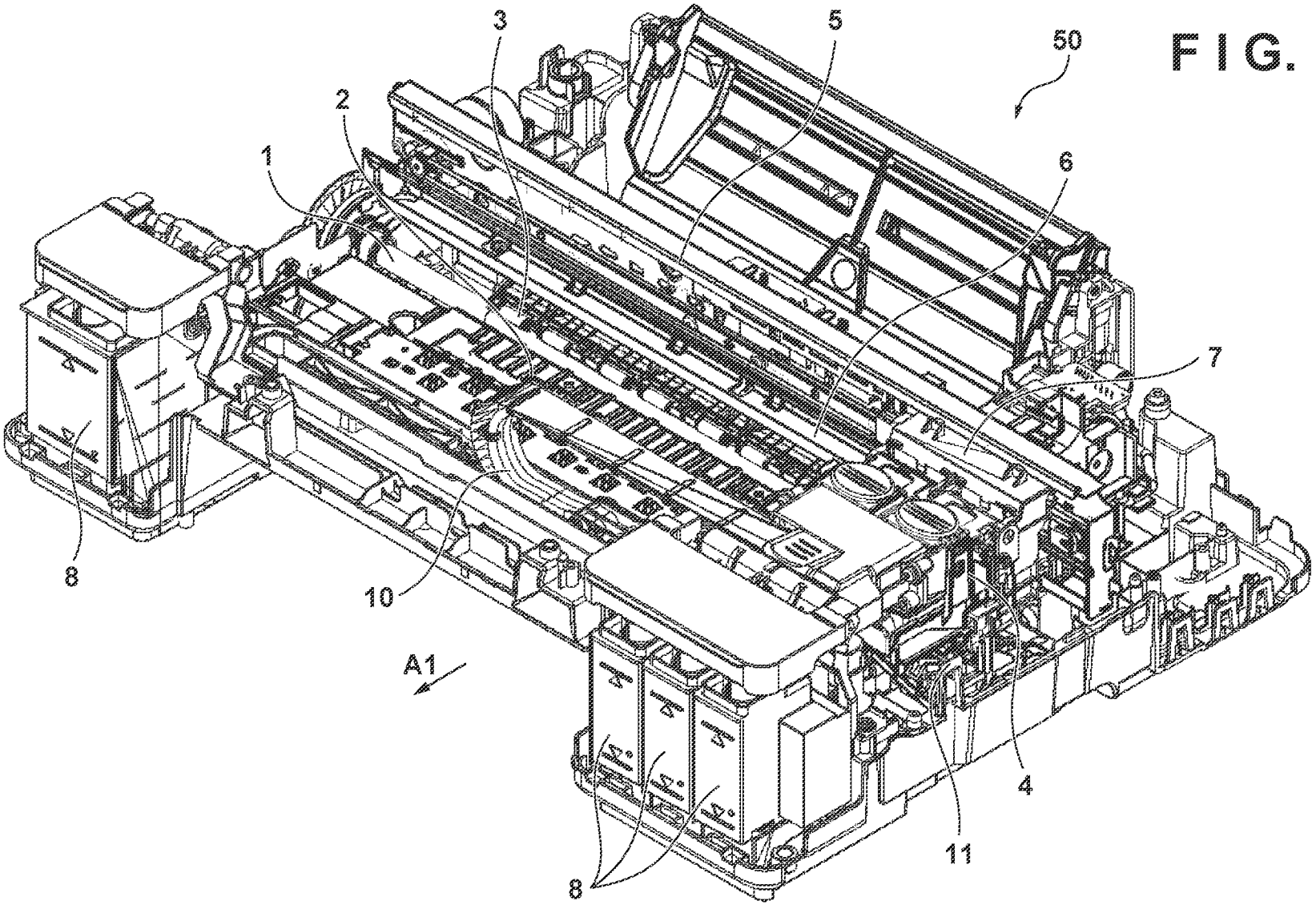
FIG. 1 is a partially cutaway perspective view showing the schematic arrangement of an inkjet printing apparatus according to an embodiment.

However, in the configuration of the above-described conventional technique, even when the ink injection port is covered by the lid, if sealing is incomplete because a tank cap is not attached due to an operation error by a user or the like, a problem as described below may occur. That is, if the ink liquid level in the ink tank is higher than that in the nozzle of the print head, a pressure is applied to the nozzle of the print head, and this impairs the stable supply of ink.

Conventionally, there is also known a printing apparatus including an ink tank arranged such that the ink liquid level in the ink tank becomes lower than that in the nozzle of the print head. However, this decreases the degree of freedom in arrangement of the ink tank, resulting in a problem that the apparatus height increases and the apparatus size increases.

This embodiment provides a small-scale printing apparatus that stably supplies ink to a print head and has a high degree of freedom in arrangement of an ink tank.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

Note that in this specification, the term "printing" (to be also referred to as "print" hereinafter) not only includes the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

In addition, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to also be referred to as a "liquid" hereinafter) should be extensively interpreted in a manner similar to the definition of "printing (print)" described above. That is, "ink" includes a liquid which, when applied onto a print medium, can form images, figures, patterns, and the like, can process the print medium, or can process ink (for example, solidify or insolubilize a coloring material contained in ink applied to the print medium).

Furthermore, a "nozzle" generically means an orifice or a liquid channel communicating with it, and an element for generating energy used to discharge ink, unless otherwise specified.

A substrate for a print head (head substrate) used below means not merely a base made of a silicon semiconductor, but a configuration in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

FIG. 1 is a perspective view showing the schematic arrangement of an inkjet printing apparatus (to be referred to as a printing apparatus hereinafter) according to a representative example of the present invention.

When printing is performed by a printing apparatus 50 shown in FIG. 1, a print medium is fed by a feeding roller (not shown), nipped between a conveyance roller 1 and a pinch roller 2 driven by the conveyance roller 1, and conveyed, by rotation of the conveyance roller 1, in an arrow A1 direction in FIG. 1 while being guided and supported on a platen 3. The conveyance roller 1 is a metal roller processed such that a large friction force can be generated by minute unevenness formed in the surface thereof. The pinch roller 2 is elastically biased against the conveyance roller 1 by a spring (not shown) or the like. The platen 3 supports the reverse surface of the print medium such that the distance between the ink discharge surface of a print head 4 and the observe surface of the print medium is maintained at a constant or predetermined distance.

The print medium conveyed onto the platen 3 is then nipped between a discharge roller (not shown) and a spur, which is a rotating body driven by the discharge roller, and conveyed. The discharge roller is a rubber roller having a high friction coefficient. The spur is elastically biased against the discharge roller by a spring (not shown) or the like. After image printing, the print medium is discharged from the platen 3 to the outside of the apparatus by rotation of the discharge roller.

The print head 4 is detachably mounted, in a posture of discharging ink toward the print medium, on a carriage 7, which is reciprocated by a carriage motor or the like along vertically-arranged guide rails 5 and 6. The moving direction of the carriage 7 is a direction crossing the conveyance direction (arrow A1 direction) of the print medium, which is also referred to as a main scanning direction. On the other hand, the conveyance direction of the print medium is referred to as a subscanning direction.

Among inkjet printing methods, the print head 4 uses a method in which, by including an electrothermal transducer (heater) that generates thermal energy as energy used for ink discharge, a state change (film boiling) of ink is generated by the thermal energy. With this method, the high density and high resolution of printing are achieved. Note that the present invention is not limited to the method using the thermal energy as described above, but a method may be used in which, by including a piezoelectric element, vibration energy generated by the piezoelectric element is used.

A plurality of nozzle arrays for discharging inks of different colors are provided in the ink discharge surface of the print head 4. A plurality of independent ink tanks 8 are attached and fixed to the apparatus main body so as to correspond to the color of ink discharged from the print head 4. The ink tanks 8 and the print head 4 are connected by joints (not shown) by a plurality of supply tubes 10 each corresponding to each color of ink, so that the ink of color stored in each ink tank 8 can be independently supplied to each nozzle array of the print head 4 corresponding to the ink color.

Further, in a non-printing region which is within the reciprocation range of the print head 4 but outside the passage range of a print medium P being conveyed, a recovery unit 11 is arranged facing the ink discharge surface of the print head 4. The recovery unit 11 includes a cap used for capping of the ink discharge surface of the print head 4, a suction mechanism for forcibly sucking the ink from the print head 4 while the ink discharge surface is capped, and a cleaning blade or the like for wiping off dirt on the ink discharge surface.

Figure 2:
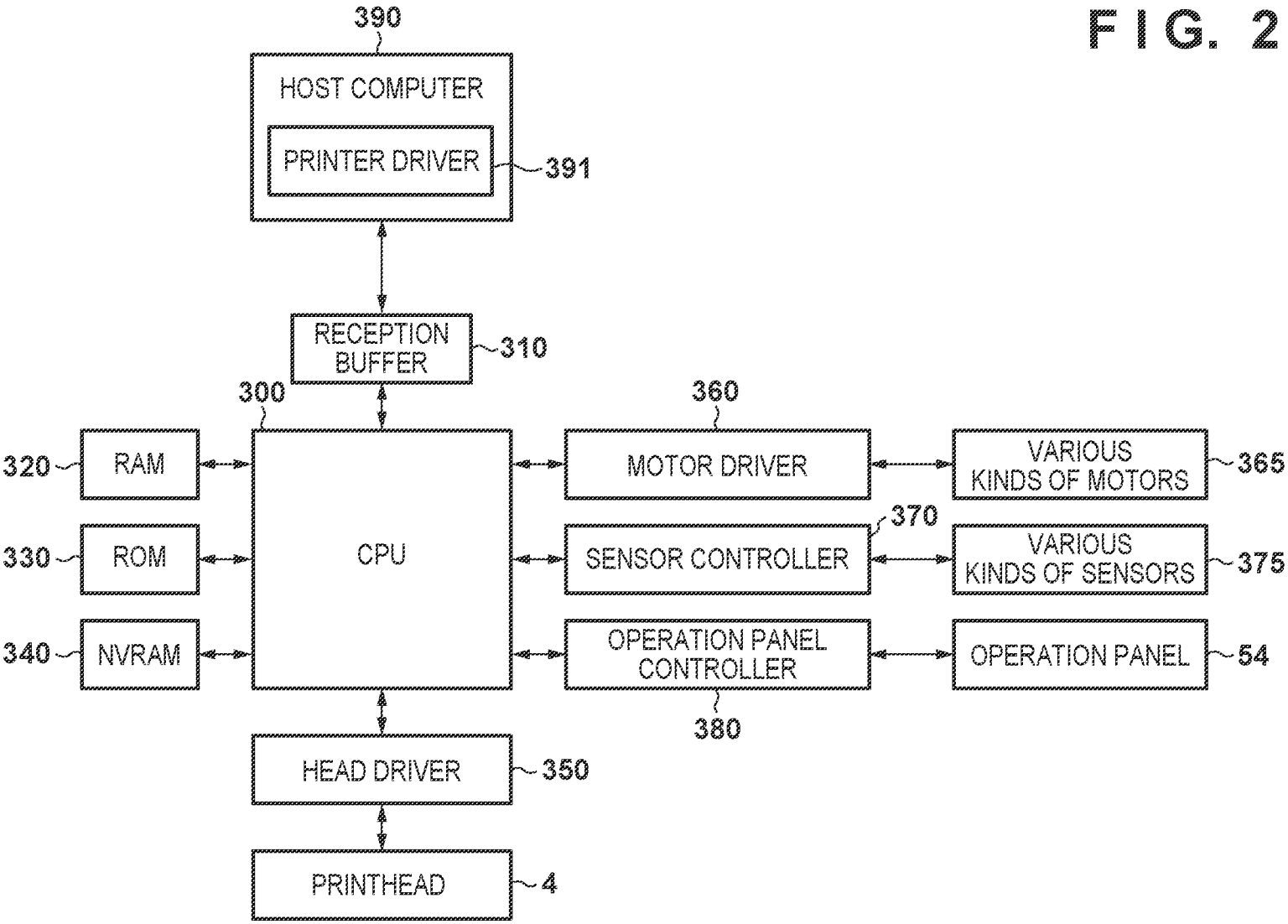
FIG. 2 is a block diagram showing the control configuration of the printing apparatus shown in FIG. 1.

FIG. 2 is a block diagram showing the control configuration of the printing apparatus shown in FIG. 1.

As shown in FIG. 2, for example, by a USB interface or the like, the printing apparatus 50 is connected to a host computer 390 with a printer driver 391 installed. The printer driver 391 generates print data from image data such as user's desired document or photograph in accordance with a print instruction of the user, and transmits the print data to the printing apparatus 50. The print data or the like transmitted from the host computer 390 to the printing apparatus 50 is temporarily held in a reception buffer 310.

The printing apparatus 50 includes a CPU 300 that controls the overall apparatus, a ROM 330 storing control software, a RAM 320 that is temporarily used when the printing apparatus 50 operates the control software, and an NVRAM 340 that holds information without power supply. Under the control of the CPU 300, the print data or the like held in the reception butter 310 is transferred to the RAM 320 and temporary stored there. The CPU 300 executes various kinds of operations such as calculation, control, determination, and setting while accessing the RAM 320, the ROM 330, the NVRAM 340, or the like.

Further, the CPU 300 drives the print head 4 via a head driver 350, controls an operation panel 54 via an operation panel controller 380, and drives various kinds of motors 365 via a motor driver 360. The various kinds of motors 360 include the carriage motor, a conveyance motor, a motor for vertically moving the cap, and the like. Furthermore, the CPU 300 controls various kinds of sensors 375 via a sensor controller 370.

Next, some examples of the ink supply configuration from the ink tank to the print head in the printing apparatus having the configuration as described above will be described in detail with reference to the drawings.

Example 1

Figure 3:
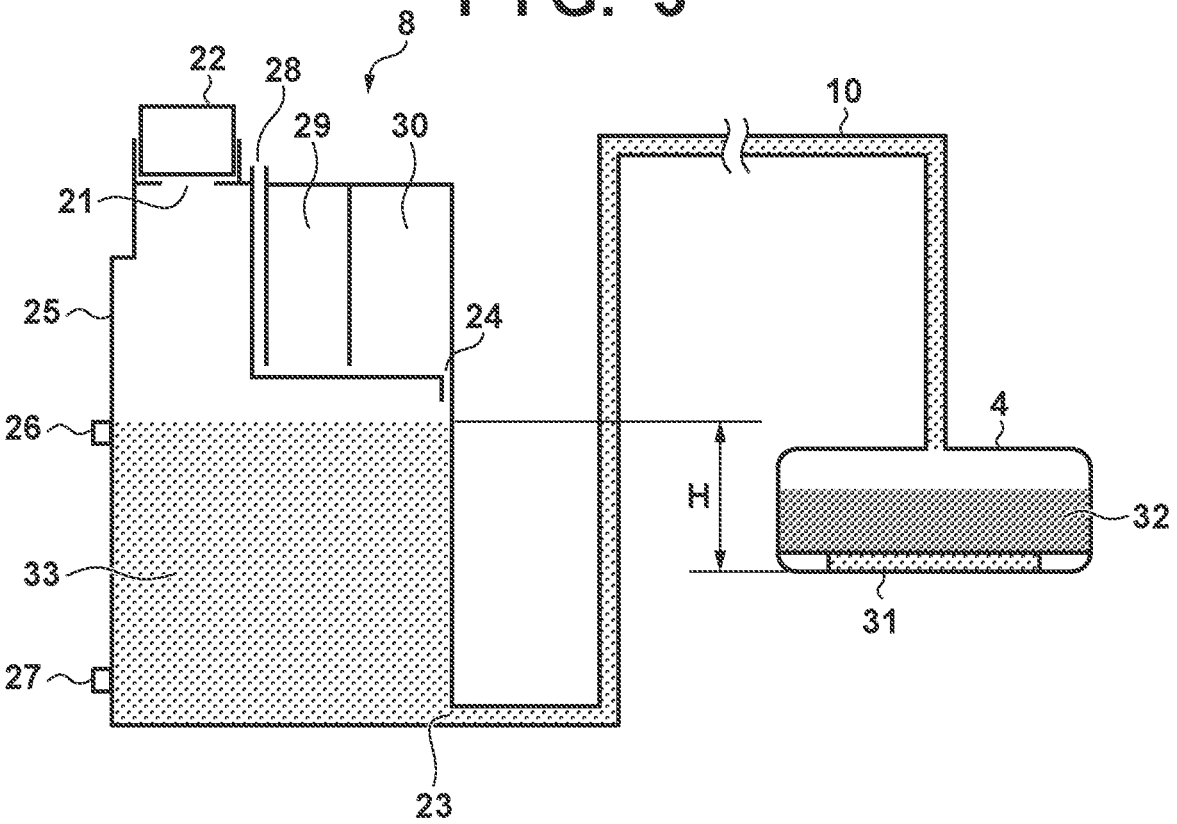
FIG. 3 is a view schematically showing the ink supply configuration from an ink tank to a print head according Example 1 of the present invention.

FIG. 3 is a view schematically showing the ink supply configuration from the ink tank to the print head according to Example 1 of the present invention.

According to FIG. 3, as also suggested in FIG. 1, the ink tank 8 is provided for each corresponding ink color, and the supply tube 10 is attached to each ink tank 8. An air communication port 28 is provided in the ink tank 8, and the air communication port 28 communicates with an ink storage portion (first space) 33 via buffer chambers 29 and 30 and a communication portion 24. An ink injection port 21 is open in the upper portion of the ink tank 8, and a tank cap 22 is attached to the ink injection port 21. A user can inject ink to the ink storage portion 33 by removing the tank cap 22.

At least a part of a side surface of the ink tank 8 serves as a visual recognition surface 25 formed by a member made of a transparent material. The user can visually recognize the ink liquid level in the ink tank 8 through the visual recognition surface 25. Protruding portions 26 and 27 are provided on the visual recognition surface 25, and they respectively indicate the highest position and lowest position of the ink liquid level for a normal printing operation. During a printing operation, ink corresponding to the amount of ink discharged from the print head 4 is continuously supplied through the supply tube 10 from an ink supply portion 23 provided in the bottom surface portion of the ink storage portion 33. In a state in which ink is consumed by the printing operation and the ink liquid level is lowered to the position of the protruding portion 27, it is required to inject ink from the ink injection port 21. By injecting ink so as to be located within a range from the protruding portion 27 to the protruding portion 26, the user can perform the printing operation without running out of ink. Note that the defining portions that respectively define the highest position and lowest position of the ink liquid level are not limited to the protruding portions 26 and 27, and lines or the like provided on the visual recognition surface 25 can be alternatively used.

If the apparatus main body is turned upside down during transportation of the main body or the like, each of the buffer chambers (second spaces) 29 and 30 can store the ink flowing out due to the air expanded in the ink storage portion 33 because of a temperature change or the like. This can prevent the ink from leaking out of the ink tank through the air communication port 28. After the transportation, when the main body is returned to the normal posture, the ink having flown into the buffer chambers 29 and 30 returns to the ink storage portion 33, and a normal printing operation can be performed.

Note than in the example of the ink tank 8 shown in FIG. 3, the ink tank 8 is configured to include two buffer chambers. However, the ink tank 8 may be configured to include one buffer chamber, or may be configured to include three or more buffer chambers.

Figure 4:
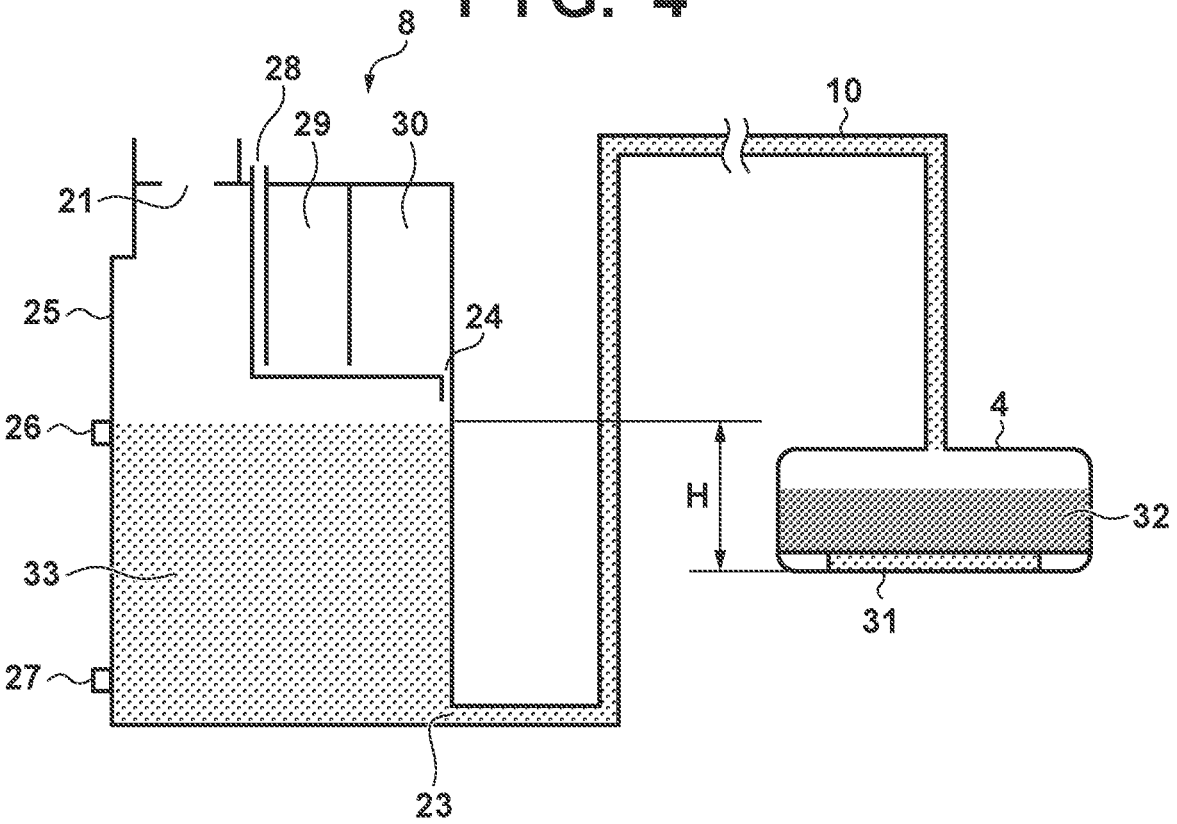
FIG. 4 is a view schematically showing a state at the time of ink injection in the ink supply configuration shown in FIG. 3.

FIG. 4 is a view schematically showing a state at the time of ink injection in the ink supply configuration shown in FIG. 3. Particularly, FIG. 4 shows a state in which the tank cap 22 has been removed from the ink tank 8.

As shown in FIGS. 3 and 4, a porous body 32 is provided in the print head 4, and a negative pressure caused by a capillary force is applied to a nozzle array 31. This negative pressure is determined by the compression rate and ink amount of the porous body 32 stored in the print head 4. The negative pressure becomes large (strong) if the compression rate is high, and the negative pressure becomes small (weak) if the compression rate is low. On the other hand, the negative pressure becomes small (weak) if the ink amount is large, and the negative pressure becomes large (strong) if the ink amount is small.

Hereinafter, in order to facilitate the association with the water head difference, the pressure unit for the description uses mmAq (millimeter water column), and the specific gravity of the ink is set to 1.

The porous body 32 is stored with the compression rate and ink filling amount that generate a negative pressure of −50 to −80 mmAq. The protruding portion 26, which indicates the highest position of the ink liquid level in the ink tank 8, is arranged at a position higher than the nozzle array 31 by a height H in the vertical direction, so that the positive water head difference corresponding to the height H is applied to the nozzle array 31. In this example, H is set to 20 mm. Here, when the negative pressure applied by the porous body 32 and the positive water head difference corresponding to the height H from the ink liquid level in the ink tank 8 are added up, the pressure at the portion of the nozzle array 31 becomes −30 to −60 mmAq. This is a pressure equal to or lower than 0 (that is, a negative pressure). That is, the absolute value of the water head difference caused by the height H is set to be equal to or smaller than the absolute value of the negative pressure generated by the porous body 32. Therefore, it is suppressed that the pressure applied to the nozzle array 31 causes ink leakage from the nozzle array 31.

Figure 5:
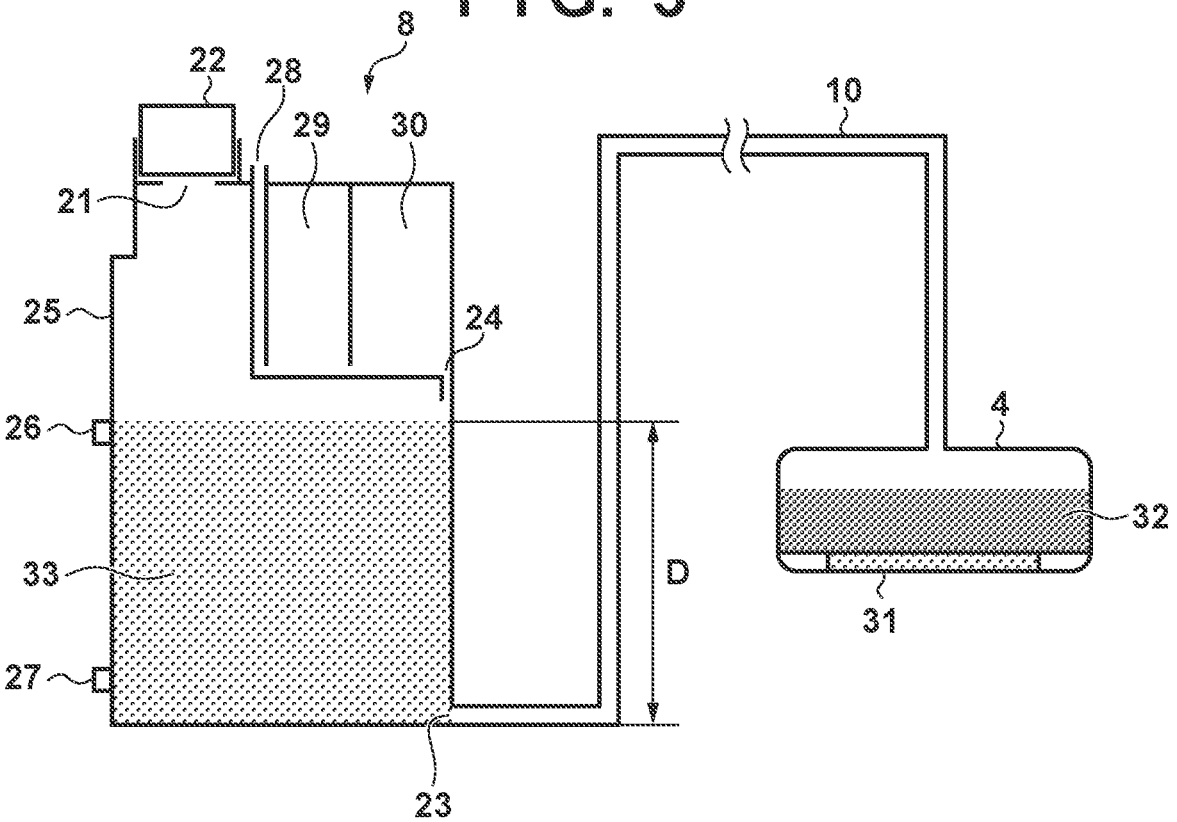
FIG. 5 is a view schematically showing a state in which there is no ink in a tube in the ink supply configuration shown in FIG. 3.

FIG. 5 is a view schematically showing a state in which there is no ink in the tube in the ink supply configuration shown in FIG. 3. As a case in which there is no ink in the tube 10 as shown in FIG. 5, a case in which air has entered from the tube surface since the printing apparatus has been left for a long time or the like, a state in which the user has forgotten to inject ink, or the like can be conceived. That is, a phenomenon occurs in which air entering from the tube surface pushes the ink in the tube 10 toward the ink tank 8. Note that as the material of the tube 10, a styrene thermoplastic elastomer which is relatively inexpensive and has a good gas barrier property is used.

As shown in FIG. 5, if there is no ink in the tube 10, the positive water head difference corresponding to a depth D from the highest ink liquid level in the ink tank 8 to the bottom surface of the ink tank 8 is applied to the nozzle array 31. In this example, the depth D is set to 40 mm. Here, when the negative pressure applied by the porous body 32 and the positive water head difference corresponding to the depth D are added up, the pressure at the portion of the nozzle array 31 becomes −10 to −40 mmAq. This is a pressure (negative pressure) equal to or lower than 0. That is, the absolute value of the water head difference caused by the depth D is set to be equal to or smaller than the absolute value of the negative pressure generated by the porous body 32. Therefore, also in this case, it is suppressed that the pressure applied to the nozzle array 31 causes ink leakage from the nozzle array 31.

Thus, according to Example 1 described above, the position of the nozzle array of the print head can be arranged within the fluctuation range of the ink liquid level in the ink tank. Hence, the height of the printing apparatus itself can be kept low. In addition, even when an operation error by the user such as forgetting closing the tank cap occurs or even when the printing apparatus is left for a long time, the pressure is not applied to the nozzle array, and ink can be supplied stably. Accordingly, downsizing of the printing apparatus is achieved, and the high reliability is maintained.

Example 2

Figure 6:
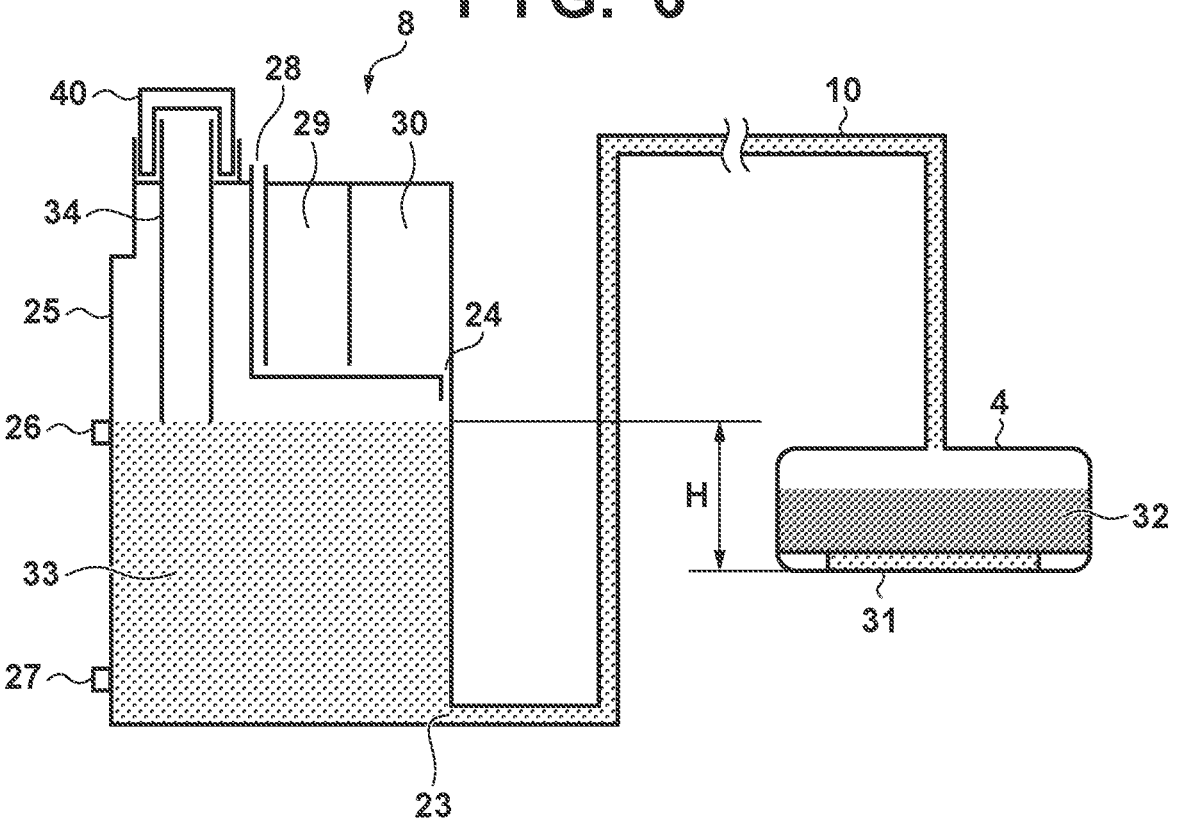
FIG. 6 is a view schematically showing the ink supply configuration from the ink tank to the print head according to Example 2 of the present invention.

FIG. 6 is a view schematically showing the ink supply configuration from the ink tank to the print head according to Example 2 of the present invention. Note that in FIG. 6, the same components as those in Example 1 described with reference to FIGS. 3 to 5 have the same reference numerals, and a description thereof will be omitted.

As shown in FIG. 6, a tubular ink injection auxiliary member 34 forming a flow passage is attached to the ink tank 8, and this allows the outside of the ink tank 8 to communicate with the ink storage portion 33. Except the time of ink injection, the ink injection auxiliary member 34 is sealed by a tank cap 40.

Note that the ink injection auxiliary member 34 may be integrally formed with the ink tank 8. In this example, two inner flow passages are formed in the ink injection auxiliary member 34, but three or more inner flow passages may be formed. That is, it is only required that at least two flow passages are provided, which include a flow passage for ink flowing toward the ink tank 8 from an ink bottle 41 serving as an ink replenishment container, and a flow passage for air flowing from the ink tank 8 toward the ink bottle 41.

Figure 7A:
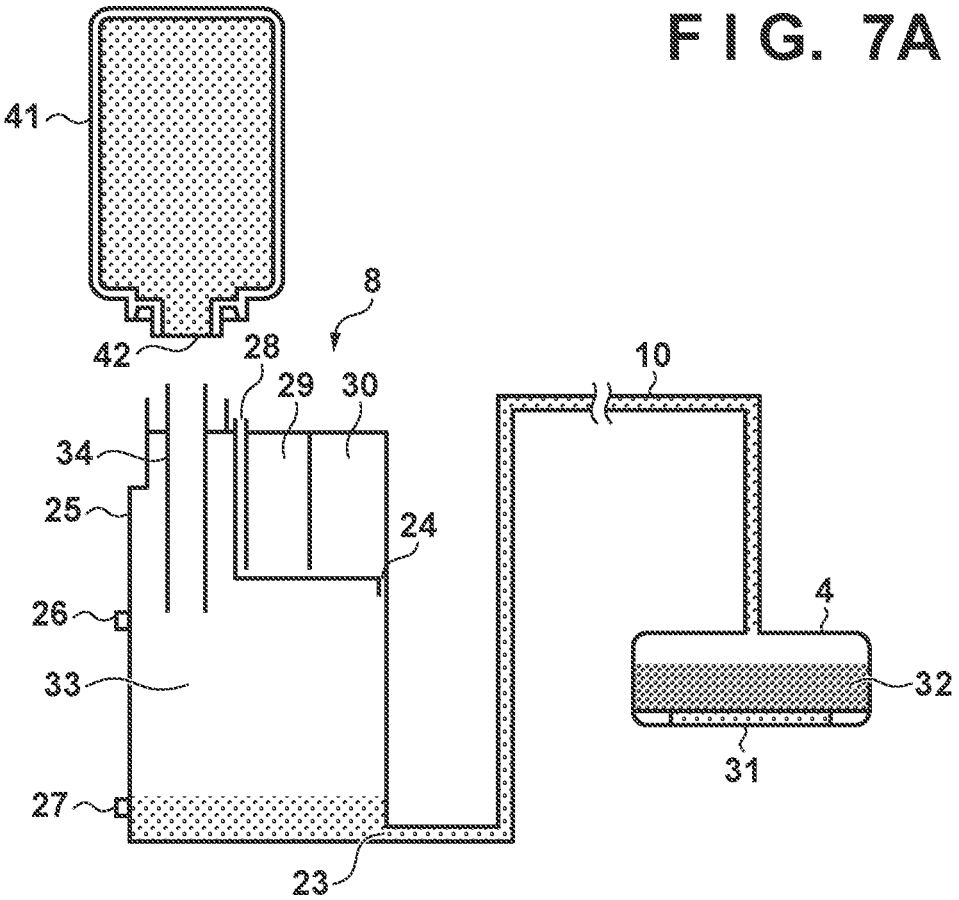
FIG. 7A is a view schematically showing a state at the time of ink injection in the ink supply configuration shown in FIG. 6.
Figure 7B:
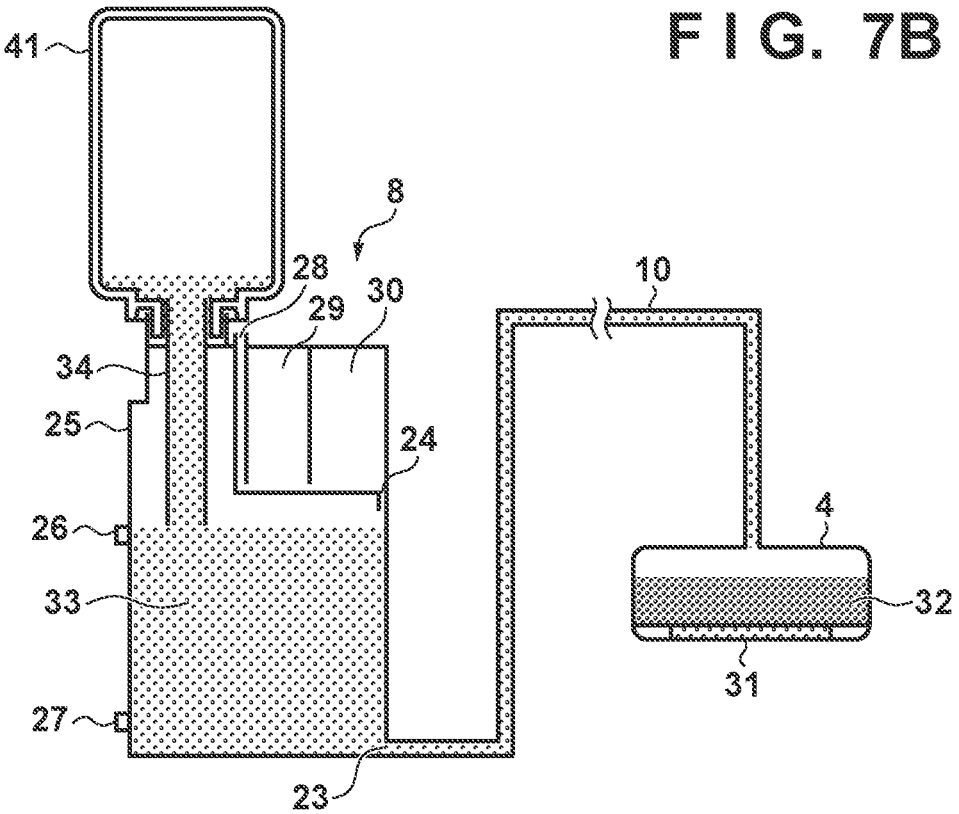
FIG. 7B is a view schematically showing another state at the time of ink injection in the ink supply configuration shown in FIG. 6.

FIGS. 7A and 7B are views each schematically showing a state at the time of ink injection in the ink supply configuration shown in FIG. 6.

FIG. 7A shows a state in which the tank cap 40 has been removed and ink injection can be performed. The ink bottle 41 stores ink, and has a structure in which a slit valve 42 with a slit formed in a thin elastic rubber member prevents the ink from leaking even when the ink bottle 41 is turned upside down. On the other hand, FIG. 7B shows a state in which the ink bottle 41 is connected to the ink injection auxiliary member 34. When the distal end of the ink injection auxiliary member 34 extends through the slit of the slit valve 42, the ink stored in the ink bottle 41 can be injected to the ink storage portion 33 of the ink tank 8. The ink injection stops when the liquid level in the ink storage portion 33 reaches the lower end of the ink injection auxiliary member 34 as shown in FIG. 7B, and the injection ends. That is, the length of the ink injection auxiliary member 34 is designed such that the liquid level at the time of injection end matches the highest position 26 of the ink liquid level in the ink tank 8. When the ink injection ends, the user pulls out the ink bottle 41 upward and attaches the tank cap 40.

As shown in FIG. 6, the highest position 26 of the ink liquid level in the ink tank 8 is arranged at a position higher than the nozzle array 31 by the height H in the vertical direction. Accordingly, the positive water head difference corresponding to the height H is applied to the nozzle array 31. In this example, the height H is set to 20 mm. Here, when the negative pressure applied by the porous body 32 and the positive water head difference corresponding to the height H are added up, the pressure (negative pressure) applied to the nozzle array 31 becomes −30 to −60 mmAq. This is a pressure equal to or lower than 0. That is, the absolute value of the water head difference caused by the height H is set to be equal to or smaller than the absolute value of the negative pressure generated by the porous body 32. Therefore, it is suppressed that the pressure applied to the nozzle array 31 causes ink leakage from the nozzle array 31.

Figure 8:
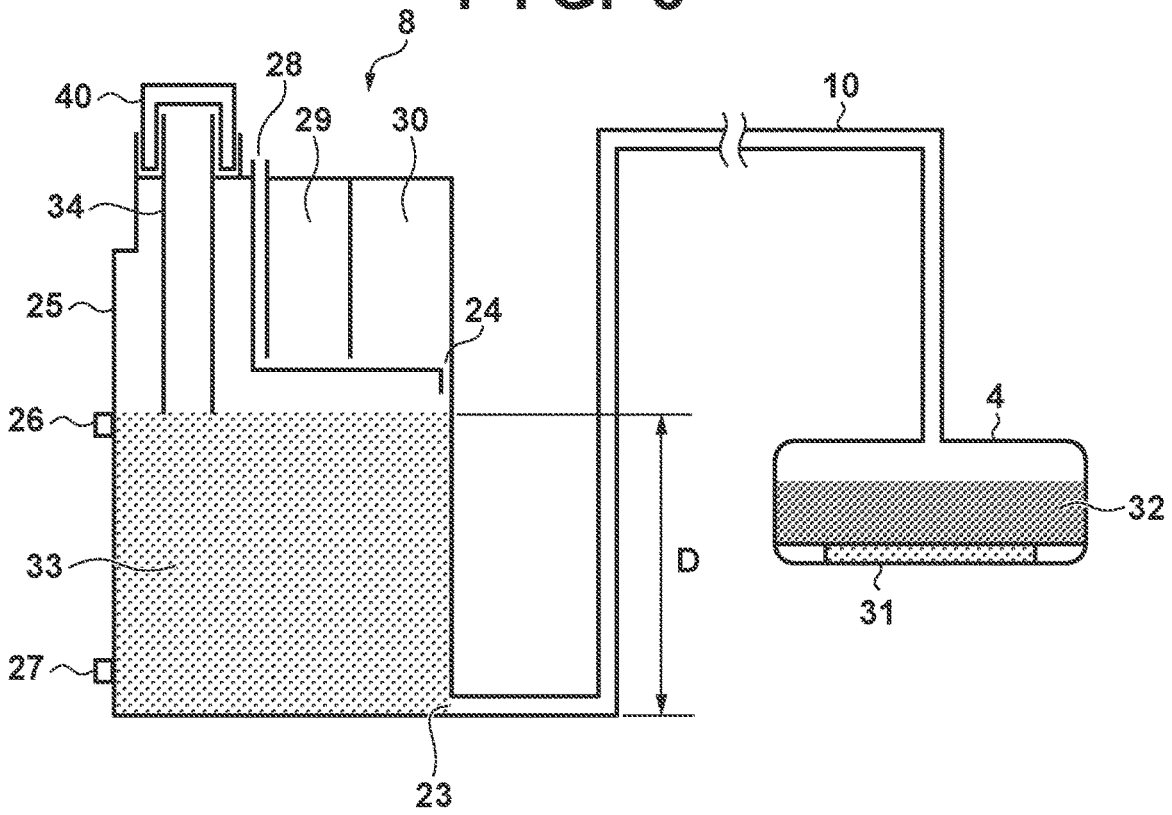
FIG. 8 is a view schematically showing a state in which there is no ink in the tube in the ink supply configuration shown in FIG. 6.

FIG. 8 is a view schematically showing a state in which there is no ink in the tube in the ink supply configuration shown in FIG. 6.

In the configuration shown in FIG. 8, the positive water head difference corresponding to the depth D from the highest ink liquid level (highest position 26) in the ink tank 8 to the bottom surface of the ink tank 8 is applied to the nozzle array 31. In this example, the depth D is set to 40 mm. Here, when the negative pressure applied by the porous body 32 and the positive water head difference corresponding to the depth D are added up, the pressure at the portion of the nozzle array 31 becomes −10 to −40 mmAq. This is a pressure (negative pressure) equal to or lower than 0. That is, the absolute value of the water head difference caused by the depth D is set to be equal to or smaller than the absolute value of the negative pressure generated by the porous body 32. Therefore, it is suppressed that the pressure applied to the nozzle array 31 causes ink leakage from the nozzle array 31.

Thus, according to Example 2 described above, in addition to the effect described in Example, 1, upon replenishing ink from the ink bottle to the ink tank, ink injection automatically stops when the maximum amount of ink is replenished. This further facilitates an ink replenishment operation by the user.

Example 3

Figure 9:
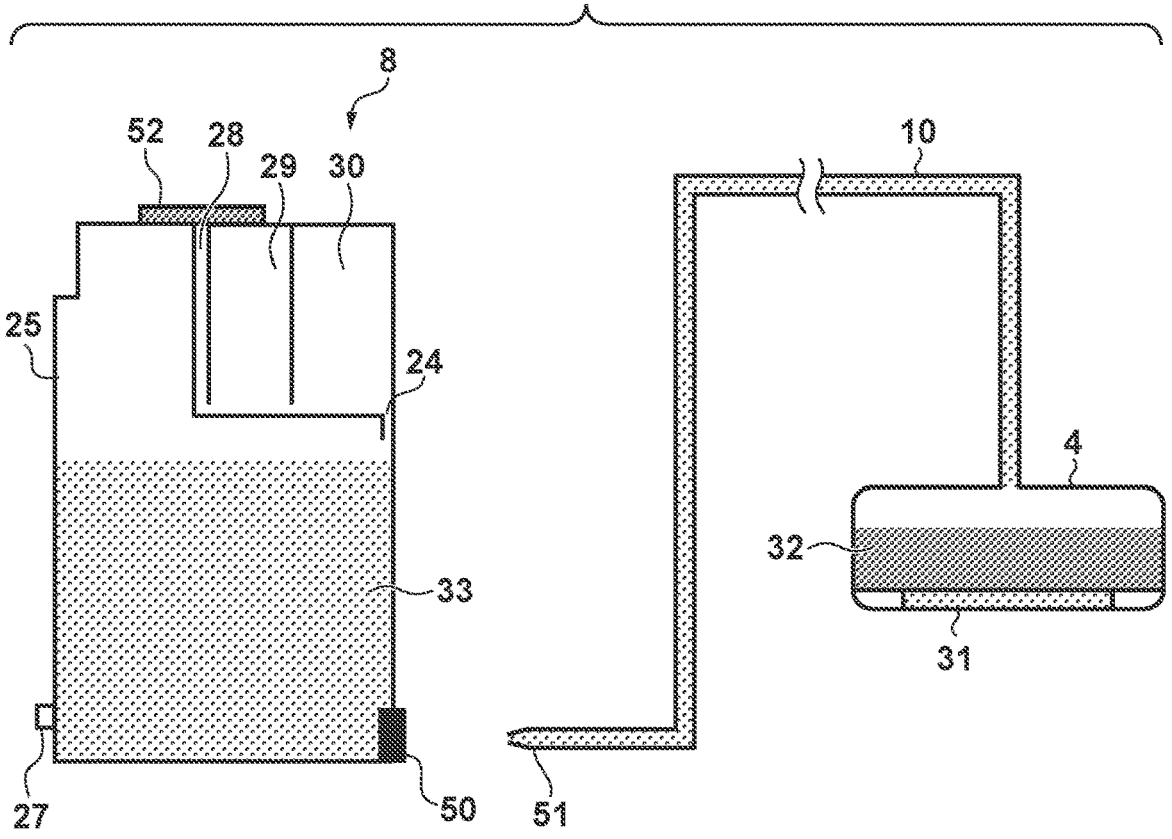
FIG. 9 is a view schematically showing the ink supply configuration from the ink tank to the print head according to Example 3 of the present invention.

FIG. 9 is a view schematically showing the ink supply configuration from the ink tank to the print head according to Example 3 of the present invention. Note that in FIG. 9, the same components as those in Example 1 described with reference to FIGS. 3 to 5 have the same reference numerals, and a description thereof will be omitted. FIG. 9 shows a state in which the ink tank 8 and the print head 4 are separated from each other.

Figure 10:
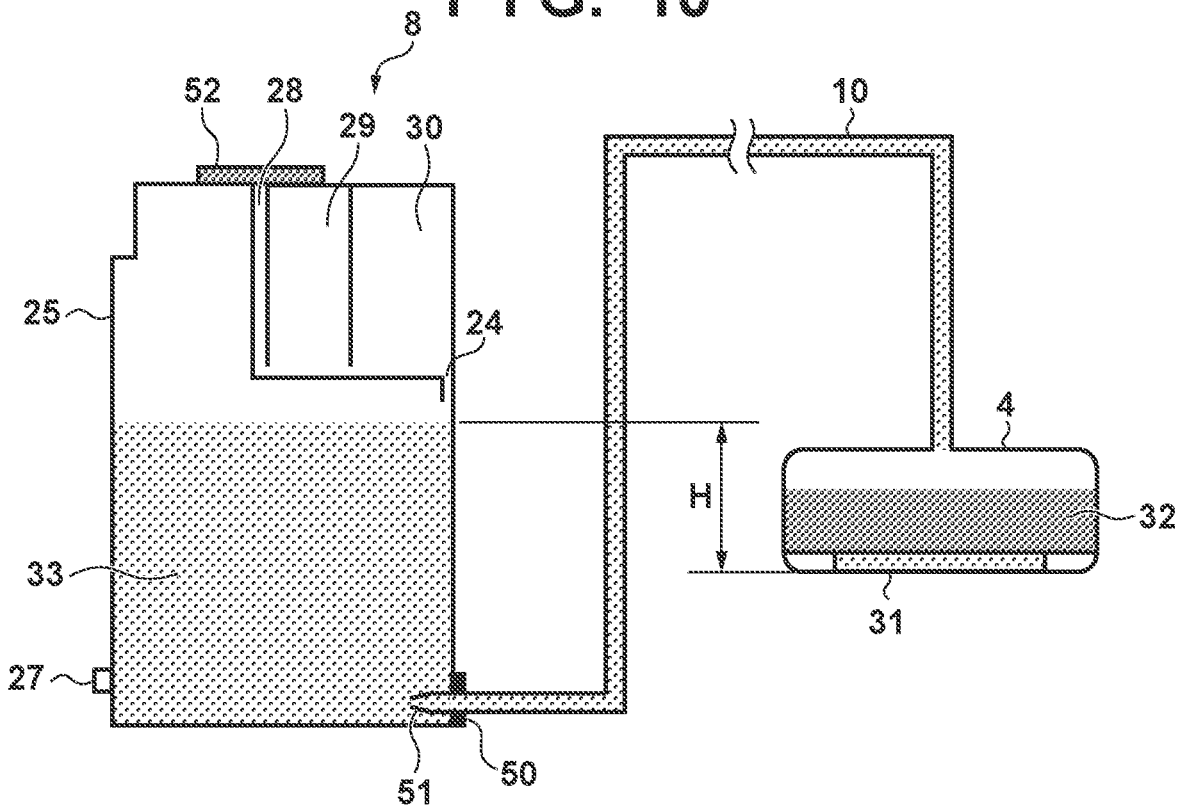
FIG. 10 is a view schematically showing a state in which the ink tank and the print head are connected to each other by a supply tube in the ink supply configuration shown in FIG. 9.

On the other hand, FIG. 10 is a view schematically showing a state in which the ink tank 8 and the print head 4 are connected to each other by the supply tube 10 in the ink supply configuration shown in FIG. 9.

As can be seen from FIGS. 9 and 10, the ink tank 8 in this example is configured to be detachable from the main body of the printing apparatus.

As shown in FIG. 9, the ink storage portion 33 of the ink tank 8 is filled with a defined amount of ink. In the upper portion of the ink tank 8, a gas/liquid separation film 52 is attached at a position where it covers the air communication port. The gas/liquid separation film 52 is formed of a material that has a property of transmitting a gas but blocking a liquid. When the ink tank 8 is placed in a direction (for example, rotated by 90° to be placed laterally) different from that in the state shown in FIG. 9, the ink in the ink tank 8 passes through the air communication port 28 and reaches the gas/liquid separation film 52, but the ink never leaks outside owing to the property described above.

Further, as shown in FIGS. 9 and 10, a supply needle 51 is attached to the distal end of the supply tube 10 on the side of the main body of the printing apparatus 50. On the other hand, a seal member 50 formed of an elastic material such as rubber is attached to the ink tank 8. When attaching the ink tank 8 to the main body of the printing apparatus, as shown in FIG. 10, the distal end of the supply needle 51 extends through the seal member 50, and the flow passage in the supply tube 10 and the ink storage portion 33 are set in a communication state.

The maximum ink amount to be injected to the ink tank 8 is defined to match the position higher than the nozzle array 31 by the height H in the vertical direction. Accordingly, the positive water head difference corresponding to the height H is applied to the nozzle array 31. In this example, the height H is set to 20 mm. Here, when the negative pressure applied by the porous body 32 and the positive water head difference corresponding to the height H are added up, the pressure at the portion of the nozzle array 31 becomes −30 to −60 mmAq. This is a pressure (negative pressure) equal to or lower than 0. That is, the absolute value of the water head difference caused by the height H is set to be equal to or smaller than the absolute value of the negative pressure generated by the porous body 32. Therefore, the pressure is not applied to the nozzle array 31.

Figure 11:
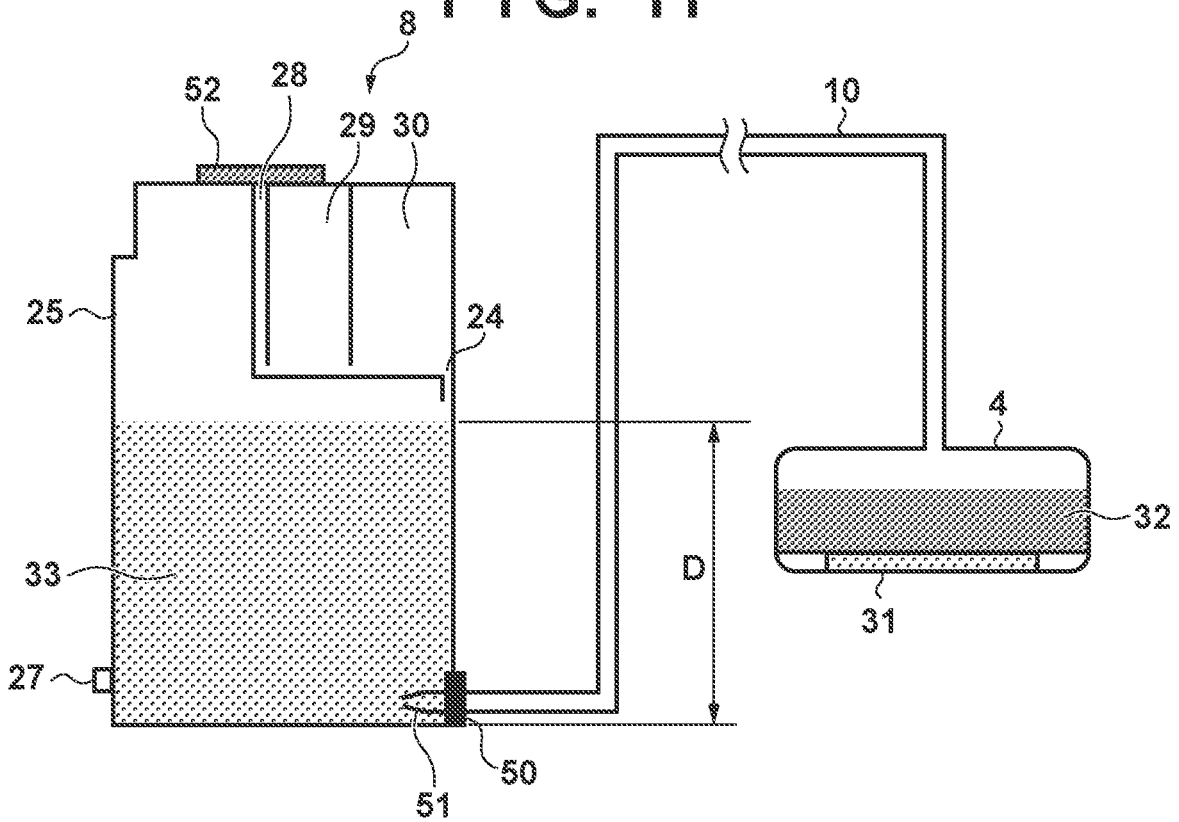
FIG. 11 is a view schematically showing a state in which there is no ink in the tube even though the print head and the ink tank are connected to each other in the ink supply configuration shown in FIG. 9.

FIG. 11 is a view schematically showing a state in which there is no ink in the tube even though the print head and the ink tank are connected to each other in the ink supply configuration shown in FIG. 9.

As shown in FIG. 11, the positive water head difference corresponding to the depth D from the highest ink liquid level in the ink tank 8 to the bottom surface of the ink tank 8 is applied to the nozzle array 31. In this example, the depth D is set to 40 mm. Here, when the negative pressure applied by the porous body 32 and the positive water head difference corresponding to the depth D are added up, the pressure at the portion of the nozzle array 31 becomes −10 to −40 mmAq. This is a pressure (negative pressure) equal to or lower than 0. That is, the absolute value of the water head difference caused by the depth D is set to be equal to or smaller than the absolute value of the negative pressure generated by the porous body 32. Therefore, it is suppressed that the pressure applied to the nozzle array 31 causes ink leakage from the nozzle array 31.

Thus, according to Example 3 described above, the position of the nozzle array of the print head can be arranged within the fluctuation range of the ink liquid level in the ink tank even in the configuration in which the ink tank and the print head (tube) can be attached/detached. Hence, the height of the printing apparatus itself can be kept low. In addition, even when the printing apparatus is left for a long time, the pressure is not applied to the nozzle array, and ink can be supplied stably. Accordingly, downsizing of the printing apparatus is achieved, and the high reliability is maintained.

Example 4

Figure 12A:
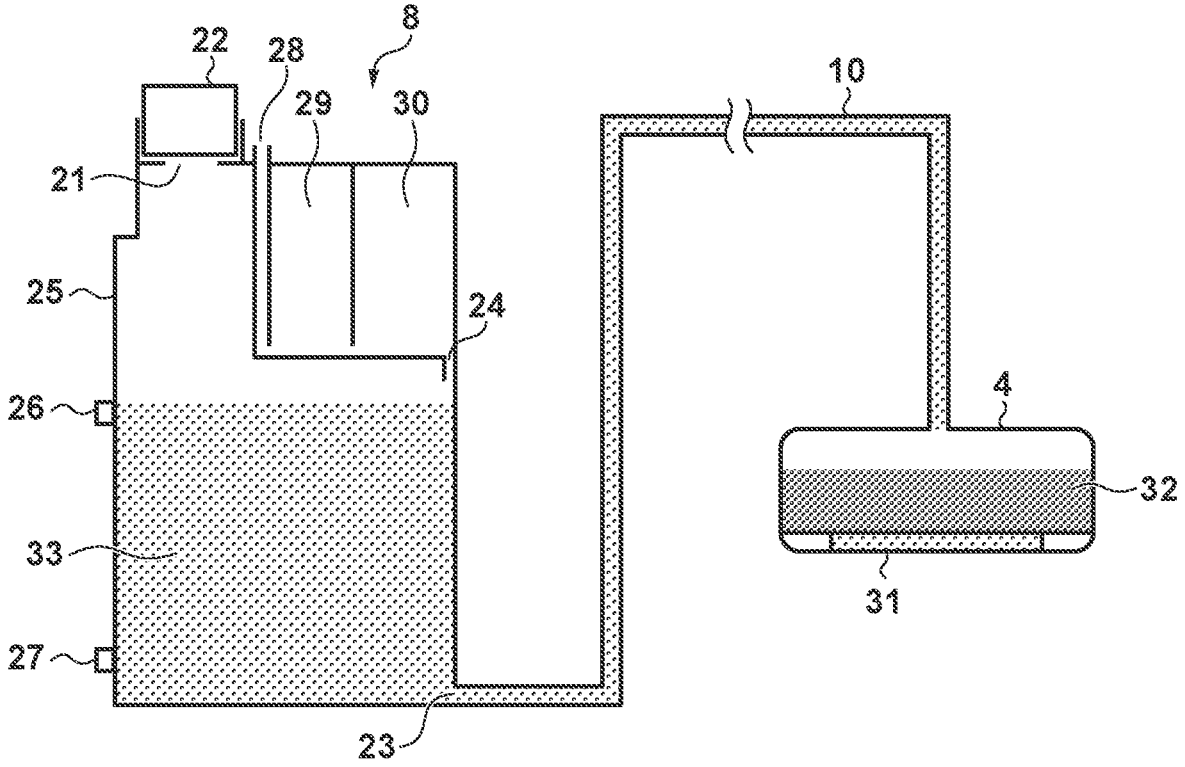
FIG. 12A is a view schematically showing the ink supply configuration from the ink tank to the print head according to Example 4 of the present invention.
Figure 12B:
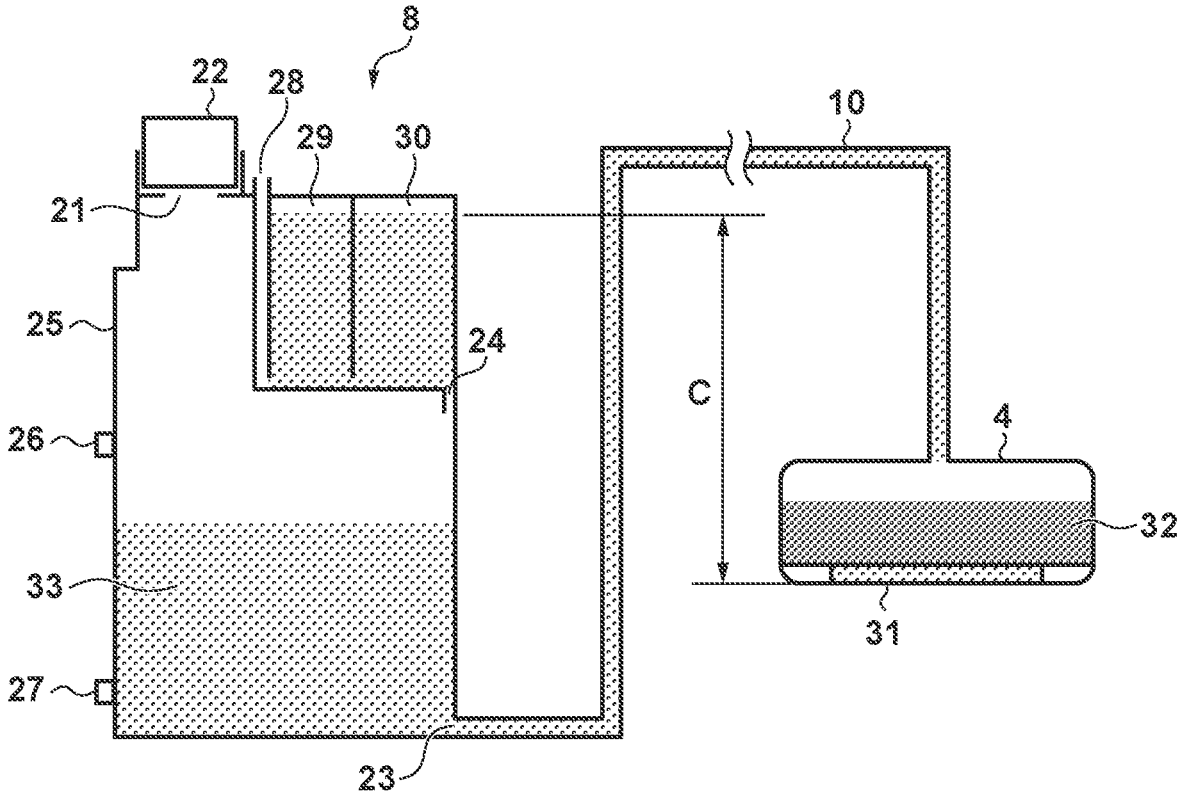
FIG. 12B is a view schematically showing the ink supply configuration from the ink tank to the print head according to Example 4 of the present invention.

FIGS. 12A and 12B are views each schematically showing the ink supply configuration from the ink tank to the print head according to Example 4 of the present invention. Note that in FIGS. 12A and 12B, the same components as those in Example 1 described with reference to FIGS. 3 to 5 have the same reference numerals, and a description thereof will be omitted.

As shown in FIGS. 12A and 12B, in a normal state, the buffer chambers 29 and 30 in the ink tank 8 are located above the ink storage portion 33 in the vertical direction. FIG. 12A shows a state in which ink has been injected to the ink tank 8, and FIG. 12B shows a state in which, after the ink tank 8 is filled with ink, the ink tank 8 is placed upside down so that the ink flows into the buffer chambers 29 and 30, and then the ink tank 8 is returned to a normal posture (normal state).

Note that here, the porous body 32 is stored with the compression rate and the ink filling amount that generate a negative pressure of −50 to −80 mmAq. Further, as shown in FIG. 12B, even if the ink flows into the buffer chambers 29 and 30, the height of the highest ink liquid level is arranged at a position higher than the nozzle array 31 by a height C in the vertical direction. Accordingly, a positive water head difference corresponding to the height C is applied to the nozzle array 31. In this example, the height C is set to 40 mm. Therefore, when the negative pressure applied by the porous body 32 and the positive water head difference corresponding to the height C are added up, the pressure at the portion of the nozzle array 31 becomes −10 to −40 mmAq. This is a pressure (negative pressure) equal to or lower than 0. That is, the absolute value of the water head difference caused by the height C is set to be equal to or smaller than the absolute value of the negative pressure generated by the porous body 32. Therefore, it is suppressed that the pressure applied to the nozzle array 31 causes ink leakage from the nozzle array 31.

Thus, according to Example 4 described above, even if, after the ink tank is filled with ink, the posture of the ink tank is changed upside down or the like so that the ink flows into the buffer chamber of the ink tank and the ink liquid level in the buffer chamber becomes higher than the nozzle array, the pressure is not applied to the nozzle array. Accordingly, ink can be supplied stably. Therefore, the high reliability is maintained. In addition, as can be seen from the configuration shown in FIGS. 12A and 12B, since it is unnecessary to make the position of the nozzle array of the print head higher than that of the ink tank, it is possible to keep the height of the printing apparatus itself low. This contributes to downsizing of the printing apparatus.

Note that in the examples described above, the porous body 32 is used as a negative pressure generating portion provided in the print head, but the present invention is not limited thereto.

Figure 13A:
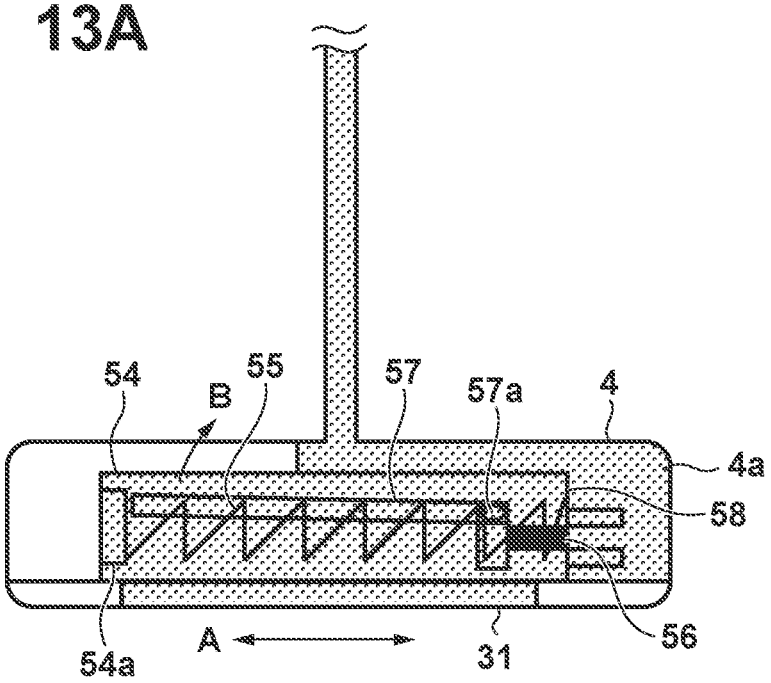
FIG. 13A is a view schematically showing another configuration of a negative pressure generating portion inside the print head.
Figure 13B:
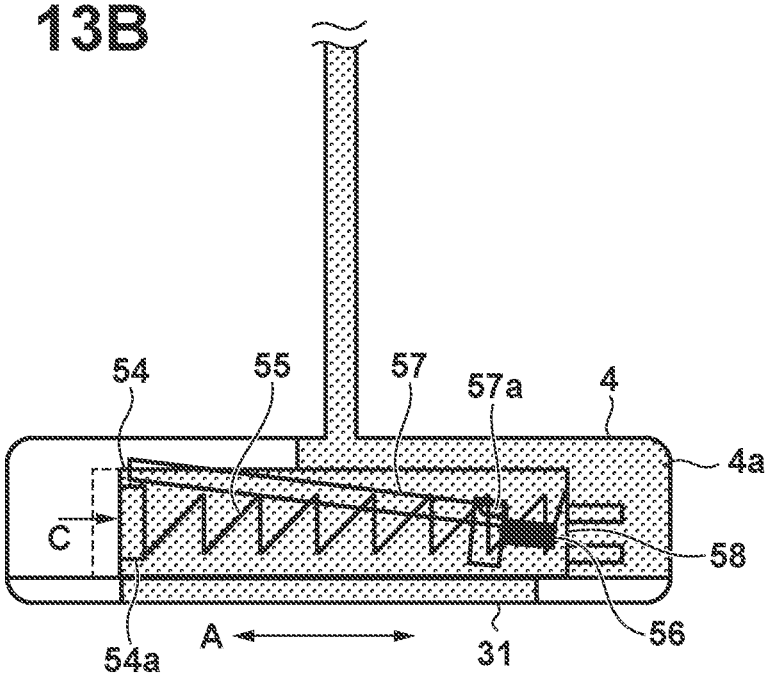
FIG. 13B is a view schematically showing the other configuration of the negative pressure generating portion inside the print head.

FIGS. 13A and 13B are views schematically showing another configuration of the negative pressure generating portion inside the print head.

FIGS. 13A and 13B show an example in which, as means for producing a negative pressure inside the print head 4, a configuration is used which uses, instead of the porous body 32, a spring bag 54 capable of storing ink and a spring 55 biased in a direction (arrow A direction) of expanding the spring bag 54 are used to maintain a negative pressure state. In this configuration, a valve 56 for properly controlling the ink amount inside the spring bag 54 is further provided. When the valve 56 is opened, ink flows into the spring bag 54 from the tube 10 and an ink liquid chamber 4*a* of the print head 4 through an inflow port 58. Opening/closing of the valve 56 is controlled by a lever 57 rotating around a rotation shaft 57*a* in an arrow B direction.

FIG. 13A shows a state in which the lever 57 abuts against an end portion 54*a* of the spring bag 54 to prevent the spring bag 54 from being contracted by the spring 55. At this time, the valve 56 is closed to close the inflow port 58, so ink does not flow into the spring bag 54. On the other hand, FIG. 13B shows a state in which the lever 57 is rotated in the arrow B direction and released from the abutment state against the end portion 54*a*, so that the spring bag 54 is contracted in an arrow C direction by contraction of the spring 55. At this time, the valve 56 is opened to open the inflow port 58, and the ink flows into the spring bag 54.

Note that the opening/closing operation of the valve 56 interlocks with rotation of the lever 57. In the state in which the lever 57 abuts against the end portion 54*a*, the valve 56 is in a closed state, and in the state in which the lever 57 is released from the abutment state against the end portion 54*a*, the valve 56 is in an open state.

As shown in FIG. 13A, when the ink liquid chamber 4*a* and the spring bag 54 of the print head 4 are filled with ink, the spring 55 extends in the arrow A direction and, as a result, the overall spring bag 54 is also expanded in the arrow A direction. At this time, the negative pressure generated by extension/contraction of the spring bag 54 becomes minimum. At this time, the valve 56 is in the closed state, and ink does not flow into the spring bag 54 from the inflow port 58.

On the other hand, when ink is discharged from the nozzle of the print head 4 and the ink inside the spring bag 54 is consumed, as shown in FIG. 13B, the spring bag 54 is contracted, by the contraction force of the spring 55, in the arrow C direction by the amount corresponding to the ink consumed amount. Along with the contraction of the spring bag 54, the abutment state of the lever 57 against the end portion 54*a* is mitigated. Then, the lever 57 rotates in the arrow B direction, the valve 56 is opened, and ink is introduced to the print head 4 and flows into the spring bag 54 via the inflow port 58. Due to the inflow of the ink, the spring bag 54 is expanded again, and the spring 55 extends in the arrow A direction.

When the spring bag 54 is filled with ink as described above, the state shown in FIG. 13A is set and the valve 56 is closed.

As shown in FIGS. 13A and 13B, even when the spring bag is used as the negative pressure generating portion in the print head 4, by storing the spring bag with the spring pressure and the ink filling amount such that a negative pressure of −50 to −80 mmAq is generated, the effect similar to that in a case in which the porous body 32 is used as the negative pressure generating portion can be obtained. Accordingly, a configuration that utilizes the elastic force of an elastic member such as a spring may be employed as the negative pressure generating portion.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-117930, filed Jul. 8, 2020 which is hereby incorporated by reference herein in its entirety.

What is claimed is:

1. A printing apparatus comprising:

a carriage on which a print head including a nozzle array for discharging a liquid is mounted, the carriage being configured to move within the printing apparatus;

a negative pressure generating portion provided in the print head and configured to apply a negative pressure to the nozzle array;

a tank configured to store the liquid; and a tube configured to supply the liquid stored in the tank to the print head, wherein the print head and the tank are connected with each other through the tube in a state where the carriage moves with the nozzle array discharging the liquid, and wherein a highest position of a liquid level in the tank in a vertical direction is higher than a position of the nozzle array, and an absolute value of a water head difference caused by a difference between the highest position of the liquid level in the tank and the position of the nozzle array is not larger than an absolute value of a negative pressure generated by the negative pressure generating portion.

2. The apparatus according to claim 1, wherein the negative pressure generating portion includes a porous body or a spring bag including a spring.

3. The apparatus according to claim 2, wherein the spring bag includes an inflow port from which the liquid flows into the spring bag, a valve configured to open and close the inflow port, and a lever configured to control opening/closing of the valve, wherein in a case where the spring contracts, the lever opens the valve and the liquid flows into the spring bag via the inflow port, and wherein in a case where the spring bag is filled with the liquid, the spring extends to make the lever close the valve.

4. The apparatus according to claim 1, wherein the tank includes an injection port for injecting the liquid into the tank, the injection port being detachably capped by a cap.

5. The apparatus according to claim 4, wherein
an injection auxiliary member forming a flow passage of the liquid is attached to the tank or integrally formed with the tank.

6. The apparatus according to claim 5, wherein
a lower end of the injection auxiliary member defines the highest position of the liquid level in the tank.

7. The apparatus according to claim 1, wherein
the tank includes a surface configured to enable visual recognition of a liquid level inside the tank, and a defining portion provided on the surface and configured to define the highest position of the liquid level.

8. The apparatus according to claim 1, wherein
the tank includes an air communication port configured to allow inside the tank to communicate with air, and a gas/liquid separation film is attached to the air communication port.

9. The apparatus according to claim 1, wherein
the tube is attachable/detachable to/from the tank.

10. The apparatus according to claim 1, wherein
an absolute value of a water head difference caused by a difference between a highest position of the liquid level in the tank and a bottom surface of the tank is not larger than an absolute value of a negative pressure generated by the negative pressure generating portion.

11. The apparatus according to claim 1, wherein the tank is fixedly held at the vertical direction in the printing apparatus.

12. A printing apparatus comprising:
a print head including a nozzle array for discharging a liquid;
a negative pressure generating portion configured to apply a negative pressure to the nozzle array;
a tank including a storage portion configured to store the liquid, and a buffer chamber provided above the storage portion in a vertical direction and configured to be capable of storing the liquid flowing out from the storage portion; and
a tube configured to supply the liquid stored in the tank to the print head, the tube being connected to the print head in a state of the print head discharging the liquid from the nozzle array,
wherein a highest position of a liquid level in the buffer chamber in the vertical direction is higher than a position of the nozzle array, and an absolute value of a water head difference caused by a difference between the highest position of the liquid level in the buffer chamber and the position of the nozzle array is not larger than an absolute value of a negative pressure generated by the negative pressure generating portion.

13. The apparatus according to claim 12, wherein
the negative pressure generating portion includes a porous body or a spring bag including a spring.

14. The apparatus according to claim 13, wherein
the spring bag includes:
an inflow port from which the liquid flows into the spring bag,
a valve configured to open and close the inflow port, and
a lever configured to control opening/closing of the valve,
wherein in a case where the spring contracts, the lever opens the valve and the liquid flows into the spring bag via the inflow port, and
wherein in a case where the spring bag is filled with the liquid, the spring extends to make the lever close the valve.

15. The apparatus according to claim 12, wherein
the tank includes an injection port for injecting the liquid into the tank, the injection port being detachably capped by a cap.

16. The apparatus according to claim 15, wherein
an injection auxiliary member forming a flow passage of the liquid is attached to the tank or integrally formed with the tank.

17. The apparatus according to claim 16, wherein
a lower end of the injection auxiliary member defines the highest position of the liquid level in the tank.

18. The apparatus according to claim 12, wherein
the tank includes a surface configured to enable visual recognition of a liquid level inside the tank storage portion, and a defining portion provided on the surface and configured to define the highest position of the liquid level.

19. The apparatus according to claim 12, wherein
the tank includes an air communication port configured to allow inside the tank to communicate with air, and a gas/liquid separation film is attached to the air communication port.

20. The apparatus according to claim 12, wherein
the tube is attachable/detachable to/from the tank.

21. The apparatus according to claim 12, wherein
an absolute value of a water head difference caused by a difference between a highest position of the liquid level in the tank and a bottom surface of the tank is not larger than an absolute value of a negative pressure generated by the negative pressure generating portion.

* * * * *